US005631551A

United States Patent [19]

Scaccianoce et al.

[11] Patent Number: 5,631,551

[45] Date of Patent: May 20, 1997

[54] VOLTAGE REFERENCE WITH LINEAR NEGATIVE TEMPERATURE VARIATION

[75] Inventors: Salvatore Scaccianoce, Riposto; Sergio Palara, Acitrezza; Natale Aiello, Catania, all of Italy

[73] Assignee: SGS-Thomson Microelectronics, S.r.l., Agrate Brianza, Italy

[21] Appl. No.: 348,030

[22] Filed: Dec. 1, 1994

[30] Foreign Application Priority Data

Dec. 2, 1993 [EP] European Pat. Off. ..... 93830488

[51] Int. Cl.[6] ..... G05F 3/04

[52] U.S. Cl. ..... 323/313; 323/281

[58] Field of Search ..... 323/313, 280, 323/281

[56] References Cited

U.S. PATENT DOCUMENTS

| | | | |
|---|---|---|---|
| 4,636,710 | 1/1987 | Stanojevic . | |
| 4,683,416 | 7/1987 | Bynum . | |
| 5,291,122 | 3/1994 | Audy | 323/313 |
| 5,325,045 | 6/1994 | Sundby | 323/313 |
| 5,352,973 | 10/1994 | Audy | 323/313 |
| 5,434,532 | 7/1995 | Thiel | 323/314 |

FOREIGN PATENT DOCUMENTS

| | | |
|---|---|---|
| 216265 | 4/1987 | European Pat. Off. . |
| 121629 | 12/1983 | United Kingdom . |

OTHER PUBLICATIONS

"Signal–Processing Circuits," Chapter 11, pp. 522–547, by Dennis L. Feucht, *Handbook of Analog Circuit Design.*

*Analysis and Design of Analog Integrated Circuits*, Second Edition, by Paul R. Gray & Robert G. Meyer, pp. 289–300.

*Primary Examiner*—Stuart N. Hecker

*Attorney, Agent, or Firm*—Robert Groover; Betty Formby

[57] ABSTRACT

A bandgap voltage reference circuit employs a Vbe voltage multiplier network in a feedback line of an output amplifier of the bandgap reference circuit, thus permitting to independently fix the output voltage that is produced and the temperature coefficient thereof. A voltage reference having a linear negative temperature coefficient in an extended temperature variation range may be obtained, starting from a bandgap reference voltage with a positive temperature coefficient.

7 Claims, 2 Drawing Sheets

$$K' = 1 + \frac{RK}{RH}$$

VOLTAGE REFERENCE WITH LINEAR NEGATIVE TEMPERATURE VARIATION

CROSS REFERENCE TO RELATED APPLICATION

This application claims priority from European app'n 93830488.8, filed Dec. 2, 1993, which is hereby incorporated by reference. However, the content of the present application is not necessarily identical to that of the priority application.

BACKGROUND AND SUMMARY OF THE INVENTION

The present invention relates to a circuit capable of generating a reference voltage having a negative temperature coefficient, starting from a bandgap reference with a positive temperature coefficient.

In a large variety of electronic circuits, it is often required that certain control parameters maintain always the same preset values, independently of the variation of temperature to which the circuit may be subject. For example a parameter to be so controlled may be the maximum limiting current that can circulate through a load, that is, for example, through a power transistor driving an external load. Commonly, such a temperature stabilization is implemented by comparing the voltage drop on a sensing resistance through which the current to be controlled flows (which voltage drop signal is normally used for driving a control and regulation feedback loop) with a reference voltage.

For example, if the control and regulation loop must intervene always upon the reaching of the same output current value, it is necessary that the reference voltage vary with the temperature with the same law of the sensing resistance, in view of the fact that a resistor (in an integrated or discrete form) notably has a non-negligible temperature coefficient.

A circuit that is widely used for generating a voltage that varies according to a precise law with the temperature, is the so-called bandgap reference circuit, a functional diagram of which is depicted in FIG. 1. Such circuits are well-known to those of ordinary skill in the art of analog design. See, e.g., Feucht, D. HANDBOOK OF ANALOG CIRCUIT DESIGN (1990); Gray and Meyer: ANALYSIS & DESIGN OF ANALOG ICS (2.ed.1984); Grebene, BIPOLAR & MOS ANALOG IC DESIGN (1984); all of which are hereby incorporated by reference.

A bandgap reference circuit as the one shown in FIG. 1, is based on the principle of exploiting variations of opposite sign with the temperature of two parameters, namely the base-emitter voltage Vbe (≈−2 mV/° C) and the so-called thermal voltage Vt (≈+0.085 mV/° C).

By referring to the diagram of FIG. 1, the bandgap voltage (Vbg) provided by the circuit is given by:

$$Vbg=Vbe\ 1+K\cdot Vt \tag{1}$$

wherein Vt is the "thermal voltage" kT/q, and K is a constant that depends on the values of the resistances RA and RB and the ratio n2/n1 between the emitter areas of the respective transistors Q1 and Q2.

Thus, by expanding the formula (1) one obtains:

$$Vbg = Vbe1 + 2\frac{RB}{RA}\cdot Vt\cdot \ln\left(\frac{n2}{n1}\right) \tag{2}$$

From the above formula (2) it may be observed that by varying the ratio RB/RA and/or n2/n1, a temperature coefficient of the Vbg that extends from −2 mV/° C. through zero to positive values may be obtained.

An intrinsic limitation of this solution, consists in the fact that the variation of the bandgap voltage (Vbg) that is generated, does not remain linear for all possible values of T, but it may be considered linear only within a restricted range of variation of temperature that becomes wider with an increase of the coefficient K.

In other words, the equation (2) ceases to be valid beyond a certain temperature and the range of linearity that is associated with the bandgap circuit of FIG. 1, becomes relatively small if a negative temperature coefficient is desired for the produced bandgap voltage Vbg.

On the other hand, in many practical applications, it is required that the voltage variation remain linear for a relatively broad temperature range, for example −40° C. to 150° C.

A further drawback of the known bandgap reference circuits, is that the choice of the thermal coefficient and of the voltage Vbg that is generated are tied together in the sense that, once the value of one of these two parameters is fixed, the other is also automatically fixed.

Therefore, there is a need for a circuit capable of generating a reference voltage with a negative temperature coefficient, starting from a bandgap reference voltage having a positive temperature coefficient, in order to obtain a broad range of linear variation with a negative temperature coefficient.

This and other objectives and advantages are obtained by the circuit for generating a reference voltage with a negative temperature coefficient, object of the present invention.

Basically, the circuit of the invention allows generation of a reference voltage with a negative starting temperature coefficient, starting from a bandgap voltage having a positive temperature coefficient. Moreover, the selection of a certain temperature coefficient does not constrain the definition of the value of the reference voltage that is produced, thus allowing independent selection of temperature coefficient and reference voltage level.

In a sample class of embodiments, the circuit of the invention comprises a common, bandgap voltage generating network and an output amplifier, that, according to the invention, is provided with a feedback network which comprises a multiplier of a Vbe voltage.

In another sample class of embodiments, a Vbe multiplier circuit is functionally connected between an output node of the amplifier and a node of the bandgap voltage generating network onto which the bandgap voltage is generated, which is connected to ground through a resistance that fixes the current that circulates through the Vbe multiplier circuit. A resistive output voltage divider is functionally connected between the output node of the amplifier and ground.

BRIEF DESCRIPTION OF THE DRAWING

The disclosed inventions will be described with reference to the accompanying drawings, which show important sample embodiments of the invention and which are incorporated in the specification hereof by reference, wherein.

The different aspects and advantages of the circuit of the invention will become more evident through the following description of several important embodiments and by referring to the attached drawings, wherein.

DETAILED DESCRIPTION OF THE PREFERRED EMBODIMENTS

Figure 1:
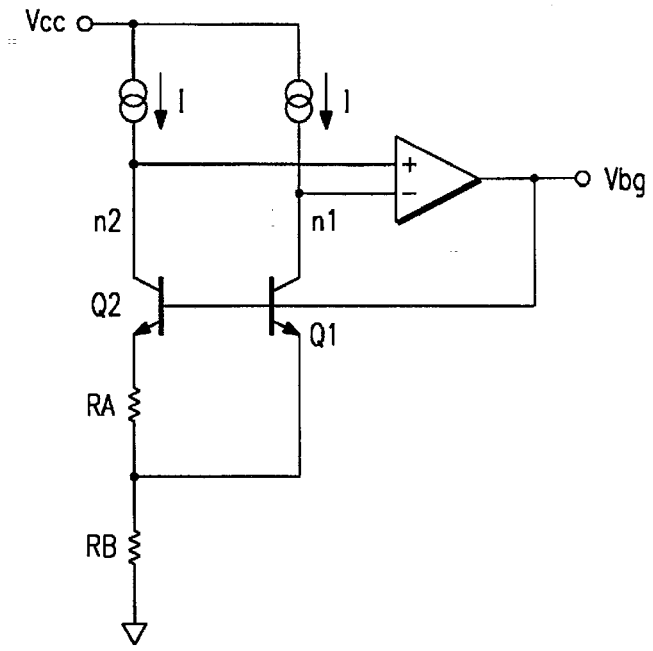
FIG. 1 (PRIOR ART)
FIG. 1 is a functional diagram of a bandgap reference voltage generating circuit according to the prior art.
Figure 2:
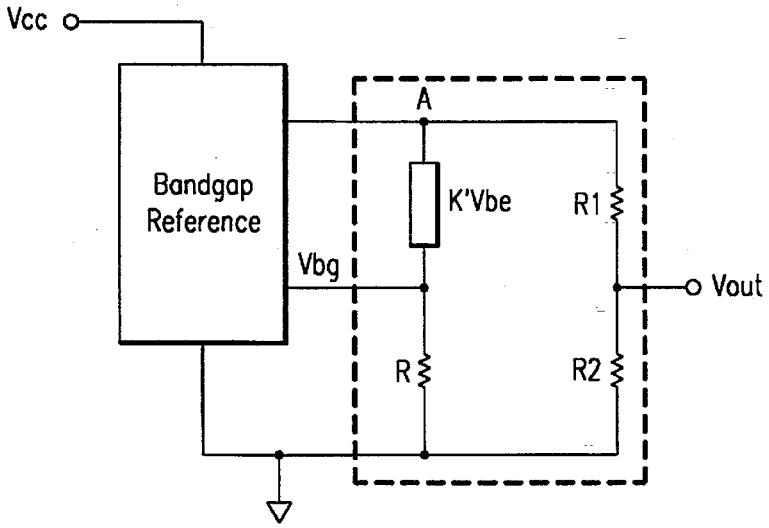
FIG. 2 is a functional block diagram of a reference voltage generating circuit according to the present invention.

The numerous innovative teachings of the present application will be described with particular reference to the presently preferred embodiment (by way of example, and not of limitation), in which:

With reference to FIG. 2, the circuit of the invention may employ a common, bandgap reference voltage generating circuit, such as the one depicted in FIG. 1, here schematically identified as a block. Of course, the bandgap voltage generating circuit may have any of the known architectures, it may be realized with junction bipolar transistors, as shown in some of the figures, but may also be realized with field effect transistors.

Between the output node A of the amplifier and the bandgap node (Vbg) of the bandgap voltage generating network, is connected a Vbe voltage multiplier circuit (K'*Vbe) through which circulates a current that, may be suitably stabilized against variations of the supply voltage.

A load resistance R is connected between the Vbg node and ground. The reference voltage Vout that is produced by the circuit may be tapped from an intermediate node of a resistive output voltage divider R1–R2, connected between the output node A of the amplifier and ground.

By analyzing the circuit of FIG. 2, $$Vout = \frac{R2}{R1+R2}\ (Vbg + K'Vbe) \tag{3}$$

wherein K' is the multiplication factor of a Vbe voltage of the relative multiplier circuit.

By differentiating in terms of temperature the equation (3), one obtains:

$$\frac{dVout}{dT} = K1 \cdot \frac{dVbg}{dT} + K1 \cdot K' \cdot \frac{dVbe}{dT} \tag{4}$$

wherein: K1=R2/(R1+R2).

Of course, for obtaining a negative temperature coefficient of the reference voltage Vout that is generated, starting from a positive temperature coefficient of the bandgap voltage Vbg, the following inequality must hold:

$$K' \cdot \left| \frac{dVbe}{dT} \right| > \frac{dVbg}{dT} \tag{5}$$

Solution of the system of equations formed by the equations (3) and (4) permits one to obtain the values of the resistive voltage divider R1–R2, as well as of the multiplication factor K' of the Vbe multiplier circuit, that are required for producing an output voltage Vout having the desired negative temperature coefficient.

Figure 3:
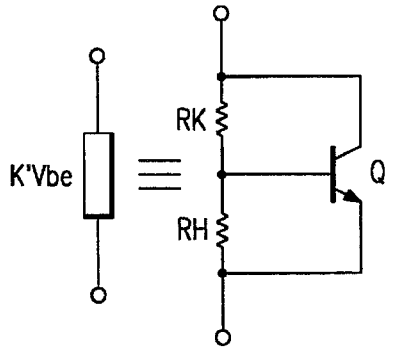
FIG. 3 is a circuit diagram of a Vbe multiplier that may be employed in the circuit of the invention.

The Vbe multiplier circuit (K'Vbe) may have any suitable circuit form. In FIG. 3 a circuit suitable to implement the Vbe multiplier circuit is shown. The circuit is composed of a bipolar transistor Q, the base of which is connected to an intermediate node of a resistive voltage divider RK–RH of the voltage present between the collector and the emitter of the transistor. The multiplication factor is given by the ratio between the two resistances RK and RH that compose the voltage divider, plus 1.

Figure 4:
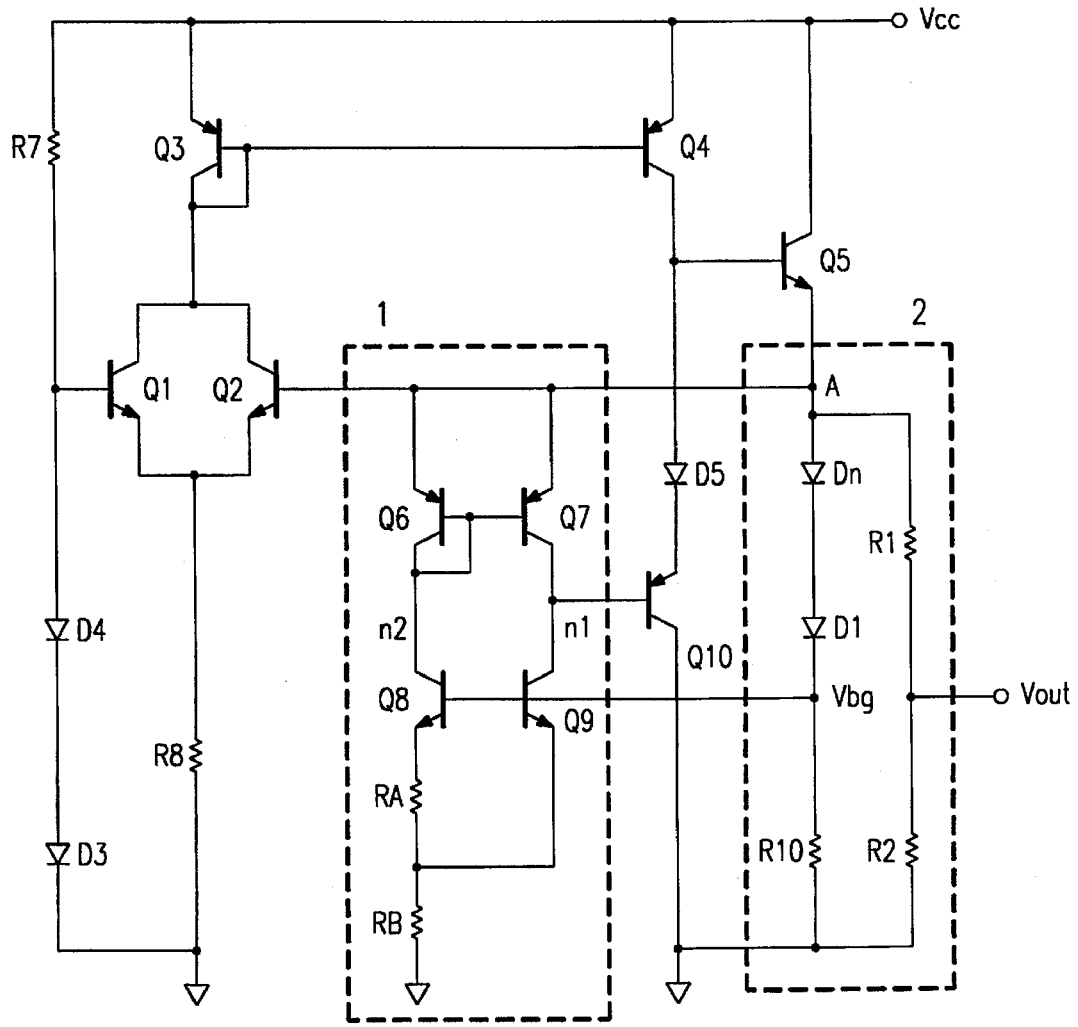
FIG. 4 is a circuit diagram of an embodiment of the circuit of the invention.

An alternative embodiment of a Vbe multiplier circuit is depicted in the circuit diagram of FIG. 4, which shows an embodiment of the whole circuit.

The bandgap voltage generating network is composed of Q6, Q7, Q8 and Q9, RA and RB, and is indicatively confined within a dashed line perimeter 1.

The output amplifier of the bandgap circuit is constituted by a first amplifying stage, composed of a common-collector configured transistor Q10, having a load constituted by a current generator Q4. Q10 "sees" as a total load, the current generator Q4 and the base of the transistor Q5, also in a common-collector configuration, which constitutes a second amplifying stage.

Through the output node A of the second amplifying stage, constituted by the transistor Q5, current is delivered to the network that characterize the circuit of the invention and which is indicatively confined in the dash line perimeter 2 of FIG. 4.

Through the output network 2, current is injected into the bases of the transistors Q8 and Q9 of the bandgap voltage generating network, thus implementing a stabilization feedback loop of the output voltage.

By assuming that on the Vbg node that corresponds to the bases of the transistors Q8 and Q9, the voltage tend to rise, the collector voltage of the transistor Q9 will tend to decrease, thus forcing Q10 to conduct more current and to subtract current from the base of Q5. As a consequence, also the emitter current of the transistor Q5 and therefore the voltage drop on R10 will tend to decrease, thus stabilizing the output voltage Vout.

In the embodiment shown in FIG. 4, the Vbe voltage multiplier circuit is constituted by a chain of directly biased diodes, D1 . . . Dn.

Advantageously, the bandgap voltage generating network, that is the emitters of transistors Q6 and Q7 that constitute the biasing current mirror of the pair of transistors Q8 and Q9, are not directly connected to Vcc, but to the output node A of the second amplifier stage onto which is intrinsically present a stabilized voltage in respect of possible variations of the supply voltage Vcc. Also the currents in the two branches of the current mirror composed of Q3 and Q4 (the latter forcing a bias current on the amplifying stage Q10) may advantageously be fixed by Q2 and R8 at a stabilized level, by driving the transistor Q2 with the stabilized voltage present on the node A. The diode D5 has the function of making symmetrical the operating conditions of the two branches (Q6-Q8 and Q7-Q9) of the mirror. In fact:

$$Vc_{Q6}+Veb_{Q6}+Vbe_{Q5}-Vd_6-Veb_{Q10}=Vc_{R7} \tag{6}$$

and therefore:

$$VC_{Q6}=Vc_{Q7} \tag{7}$$

Finally, the circuit may be completed by a "start-up" network composed of R7, D3 . . . D4 and Q1.

By analyzing again equation (2), the following relationship may be derived:

$$\frac{dVbg}{dT} = \frac{dVbe}{dT} + 2\frac{RB}{RA}\ \frac{k}{q}\ \ln(n)$$

where n=A8/A9 (A8 and A9 being the emitter areas of the respective transistors Q8 and Q9).

In view of the equation (8), equation (4) becomes:

$$\frac{dVout}{DT} = (K'+1)\frac{R2}{R1+R2}\ \frac{dVbe}{dT} + 2\frac{RB\cdot R2}{RA(R1+R2)}\ \frac{k}{q}\ \ln(n)$$

From this last equation, it is easily observed that, for obtaining a negative temperature coefficient, it will be sufficient to verify the following inequality:

$$(K'+1)\cdot\left|\frac{dVbe}{dT}\right| > 2\frac{RB}{RA}\ \frac{k}{q}\ \ln(n) \tag{10}$$

By establishing a certain value of Vout, at room temperature, the values of R1, R2, RA, RB and K' may be easily calculated, in order to obtain the desired temperature coefficient of the reference voltage Vout generated by the circuit.

From what has been described above, it is clear that all the stated objectives are fully met by the circuit of the invention, in particular a certain output voltage Vout at room temperature may be fixed according to need and on the other hand, a precise temperature coefficient may be implemented according to what required by the particular compensating circuit that will utilize the reference voltage (Vout) produced by the circuit of the invention.

Figure 5:
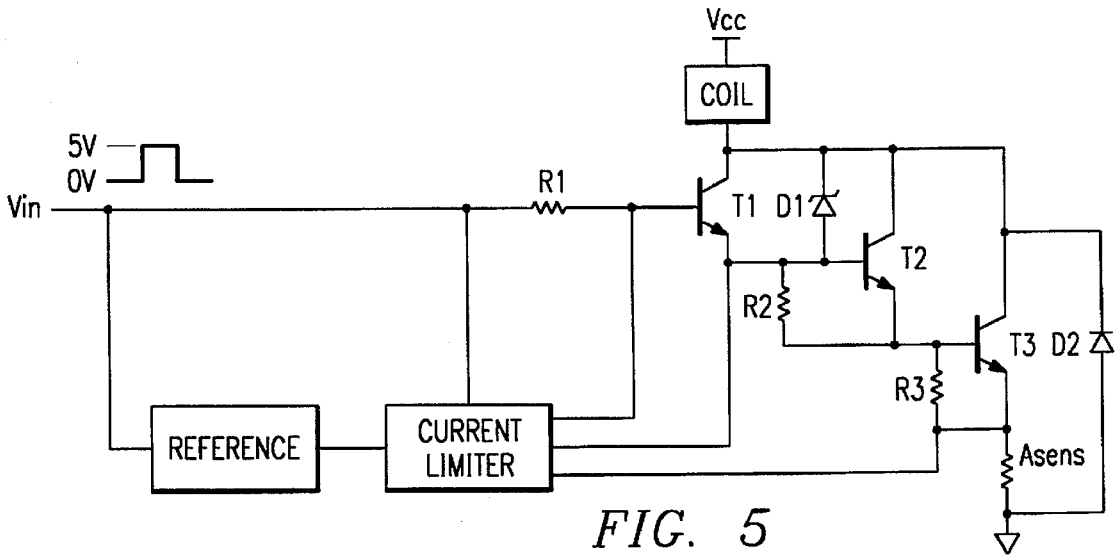
FIG. 5 shows a sample system application incorporating the innovative circuit of FIG. 2.

In a sample application, this innovative circuit has been introduced in an IC that contains a coil driver of an electronic car engine ignition system, a block diagram of which is shown in FIG. 5. The device integrates on the same chip a power Trilinton, protected by the zener D1 against collector overvoltages and a portion of the control circuit, constituted by the circuit of the invention and by a current limiting circuit of the final stage. The entire IC is powered by the input signal. The current limiter compares the voltage drop on a sensing resistor (Rsense which is also integrated) with a reference voltage generated internally. When the two voltages equal each other, the feedback loop intervenes to prevent the coil current from unlimited increases. The requirement of having a voltage reference with a negative linear variation versus temperature derives from the need of obtaining a temperature independent limit value of the current.

According to a disclosed class of innovative embodiments, there is provided: a method for providing a reference voltage, comprising the steps of: providing two transistors having unequal emitter current densities; generating a current corresponding to the difference between the base-emitter voltage drops of said two transistors, divided by a resistance value; amplifying said current to produce an amplified current; combining said amplified current with a current portion corresponding to passage of a current through multiple forward diode drops meant to produce a resultant current; feeding back said resultant current to provide base current to said two transistors; and providing said amplified current as an output current.

According to another disclosed class of innovative embodiments, there is provided: an integrated circuit for providing a reference voltage, comprising: two transistors connected to have unequal emitter current densities; means for generating a current corresponding to the difference between the base-emitter voltage drops of said two transistors, divided by a resistance value; means for amplifying said current to produce an amplified current; means for combining said amplified current with a current portion corresponding to passage of a current through multiple forward diode drops meant to produce a resultant current; and means for feeding back said resultant current to provide base current to said two transistors; whereby said amplified current provides a stable output current.

According to another disclosed class of innovative embodiments, there is provided: a circuit for generating a reference voltage with a negative temperature coefficient from a bandgap voltage with a positive temperature coefficient as generated by a bandgap reference circuit comprising a bandgap voltage generating network and an amplifier, comprising a network consisting of at least a Vbe voltage multiplier circuit, functionally connected between an output node of said amplifier and a node at said bandgap voltage of said bandgap voltage generating network, at least one resistance connected between said node at bandgap voltage and ground, and a resistive voltage divider connected between said output node of said amplifier and ground.

As will be recognized by those skilled in the art, the innovative concepts described in the present application can be modified and varied over a tremendous range of applications, and accordingly the scope of patented subject matter is not limited by any of the specific exemplary teachings given. For example, as will be obvious to those of ordinary skill in the art, other circuit elements can be added to, or substituted into, the specific circuit topologies shown.

For another example, the disclosed innovations can also be used to obtain a voltage output (Vout of FIG. 4) with a null temperature coefficient. This will occur when the temperature coefficient (positive) of the band gap voltage $V_{bg}$ perfectly matches the coefficient of the $V_{BE}$ multiplier or of the diode chain of the feedback line. The advantage of such a solution compared with a solution wherein the band gap voltage $V_{bg}$ is intrinsically temperature compensated, is represented by the broadening of the temperature range through which the voltage reference remains effectively constant.

What is claimed is:

1. A circuit for generating a reference voltage with a negative temperature coefficient from a bandgap voltage with a positive temperature coefficient as generated by a bandgap reference circuit comprising a bandgap voltage generating network and an amplifier, comprising a network consisting of at least a Vbe voltage multiplier circuit, functionally connected between an output node of said amplifier and a node at said bandgap voltage of said bandgap voltage generating network, at least one resistance connected between said node at bandgap voltage and ground, and a resistive voltage divider connected between said output node of said amplifier and ground.

2. A circuit as defined in claim 1, wherein a biasing current that is stabilized against variations of the supply voltage circulates through said bandgap voltage generating network.

3. A circuit as defined in claim 1, characterized by the fact that said amplifier comprises at least a first and a second amplifying stages.

4. A circuit as defined in claim 3, wherein each of said first and second amplifying stages is constituted by a common-collector configured bipolar transistor.

5. A circuit as defined in claim 4, wherein said Vbe voltage multiplier circuit comprises a bipolar transistor having a base connected through a first resistance to said output node of said second amplifying stage, to which a collector of the transistor is also connected, said base being further connected through a second resistance to said bandgap voltage node to which an emitter of the transistor is also connected; the multiplication factor being given by the ratio between said first resistance and said second resistance plus 1.

6. A circuit as defined in claim 1, wherein said Vbe voltage multiplier circuit comprises a plurality of directly biased diodes, connected in series between said output node of said amplifier and said bandgap voltage node.

7. A circuit as defined in claim 1, wherein said bandgap voltage generating network is supplied with the voltage present on said output node of said amplifier;

a biasing current, defined by a transistor driven by the voltage present on said output node of said amplifier and by the value of a resistance connected between said transistor and ground, being mirrored on a load element of the amplifier.

* * * * *